US007640923B1

(12) United States Patent
Chen

(10) Patent No.: US 7,640,923 B1
(45) Date of Patent: Jan. 5, 2010

(54) HIDDEN SENSOR STRUCTURE FOR PAINTBALL GUN

(75) Inventor: Yi-Tsong Chen, Tainan (TW)

(73) Assignee: Hsin-Cheng Yeh, Tainan Hsien (TW)

( * ) Notice: Subject to any disclaimer, the term of this patent is extended or adjusted under 35 U.S.C. 154(b) by 0 days.

(21) Appl. No.: 12/327,086

(22) Filed: Dec. 3, 2008

(51) Int. Cl.
*F41B 11/06* (2006.01)

(52) U.S. Cl. ..... 124/32; 124/73

(58) Field of Classification Search ..... 124/32
See application file for complete search history.

(56) References Cited

U.S. PATENT DOCUMENTS 6,966,313 B1 * 11/2005 Yokota et al. ..... 124/32
7,461,646 B2 * 12/2008 Jones ..... 124/77
2003/0221684 A1 * 12/2003 Rice ..... 124/71
2006/0107938 A1 * 5/2006 Rice ..... 124/73
2007/0209650 A1 * 9/2007 Jones ..... 124/73
2008/0078370 A1 * 4/2008 Kaakkola et al. ..... 124/73

* cited by examiner

*Primary Examiner*—Troy Chambers
*Assistant Examiner*—Reginald Tillman, Jr.
(74) *Attorney, Agent, or Firm*—WPAT, P.C.; Anthony King

(57) ABSTRACT

A hidden sensor structure for a paintball gun is to secure a loader unit on a hopper of a barrel. A loader is used to hold against the loader unit. The loader unit has arcuate slots to receive resilient stoppers therein, with studs protruding from the resilient stoppers to extend into the hopper. A sensor has an emission end, a receiving end, and a socket. The sensor is coupled to the loader unit from the bottom of the barrel, with the emission end and the receiving end inserting into two troughs formed on two sides of the load unit and the socket engaging with a fixture of the loader unit.

6 Claims, 6 Drawing Sheets

A-A

HIDDEN SENSOR STRUCTURE FOR PAINTBALL GUN

BACKGROUND OF THE INVENTION

1. Field of the Invention

The present invention relates to a hidden sensor structure for a paintball gun, and more particularly to a sensor hidden in a paintball gun to have a unity appearance.

2. Description of the Prior Art

In recent years, a paintball gun has becoming a very popular leisure game to youngsters. In order to save the high pressurized air and stop the paintballs left in a loader from wasting, a sensor and a stopper are adapted, as shown in FIG. 6. A barrel A has a pair of troughs A1 at two sides thereof, an insertion hole A2 and a receiving hole A3 thereat. The insertion hole A2 is adapted for a sensor B to be inserted therein. The receiving hole A3 is adapted to receive a nut A4, a ball A5 and a spring A6 therein in sequence and sealed with a cap C into the trough A1. The cap C is secured through a bolt C1 to the barrel A. The sensor B is covered by the cap C and is urged by the spring A6. The nut A4 restraints the ball A5 in the receiving hole A3. The inner diameter of the receiving hole A3 is smaller than the outer diameter of the ball A5 so that the ball A5 is urged by the spring A6 to move within the receiving hole A3.

However, the above-mentioned structure has a number of shortcomings.

1. The sensor is preset in the barrel and inserted into the insertion hole by means of the bolt to secure the cap. This design is not convenient to the user.
2. The trough for the cap to be secured remains a gap which may gather dust therein.
3. The trough on the barrel affects the unity appearance of the gun.

SUMMARY OF THE INVENTION

The present invention is to provide a hidden sensor structure for a paintball gun. In particular, a sensor is installed in a barrel to make the gun in a unity design.

According to the present invention, there is provided a hidden sensor structure for a paintball gun, comprising a sensor, a loader unit, and a barrel, said barrel being adapted for said loader unit and a loader to seat therein; said sensor comprising an emission end, a corresponding receiving end, and a socket, said socket having an insertion hole at a central portion thereof; said loader unit comprising a pair of troughs at two sides thereof for receiving said emission end and said receiving end therein, a first through hole for said emission end and said receiving end to communicate with each other, and a fixture protruding from a lower end thereof for said socket of said sensor to seat thereon, said fixture having a threaded hole at a central portion thereof; said barrel having a hopper at an upper end thereof for said loader unit to seat thereon and recesses formed on an inner wall thereof.

Preferably, said loader unit is a hollow cylinder corresponding to said hopper of said barrel.

Preferably, said loader unit further has a pair of arcuate slots above said troughs.

Preferably, one end of each said arcuate slot is formed with a second through hole.

Preferably, said loader unit further comprises a pair of resilient stoppers to be inserted into said arcuate slots.

Preferably, each said resilient stopper has a stud protruding from an inner side thereof, said stud extending through said second through hole into said hopper of said barrel.

Preferably, the barrel has the hopper on top of the barrel for the loader unit and the loader to be seated thereon.

Preferably, the recesses formed on the inner wall of the barrel correspond in position to the resilient stoppers of the loader unit, and are adapted for the studs to be inserted therein.

The present invention has the following advantages.

1. The sensor is coupled to the load unit from the bottom of the barrel such that the sensor is hidden in the barrel to form a unity appearance.
2. The loader unit is sealed in the barrel without necessary of another lid to cover.
3. There is no lid or threaded fasteners on the barrel, preventing dust from entering.

DETAILED DESCRIPTION OF THE PREFERRED EMBODIMENT

Figure 1:
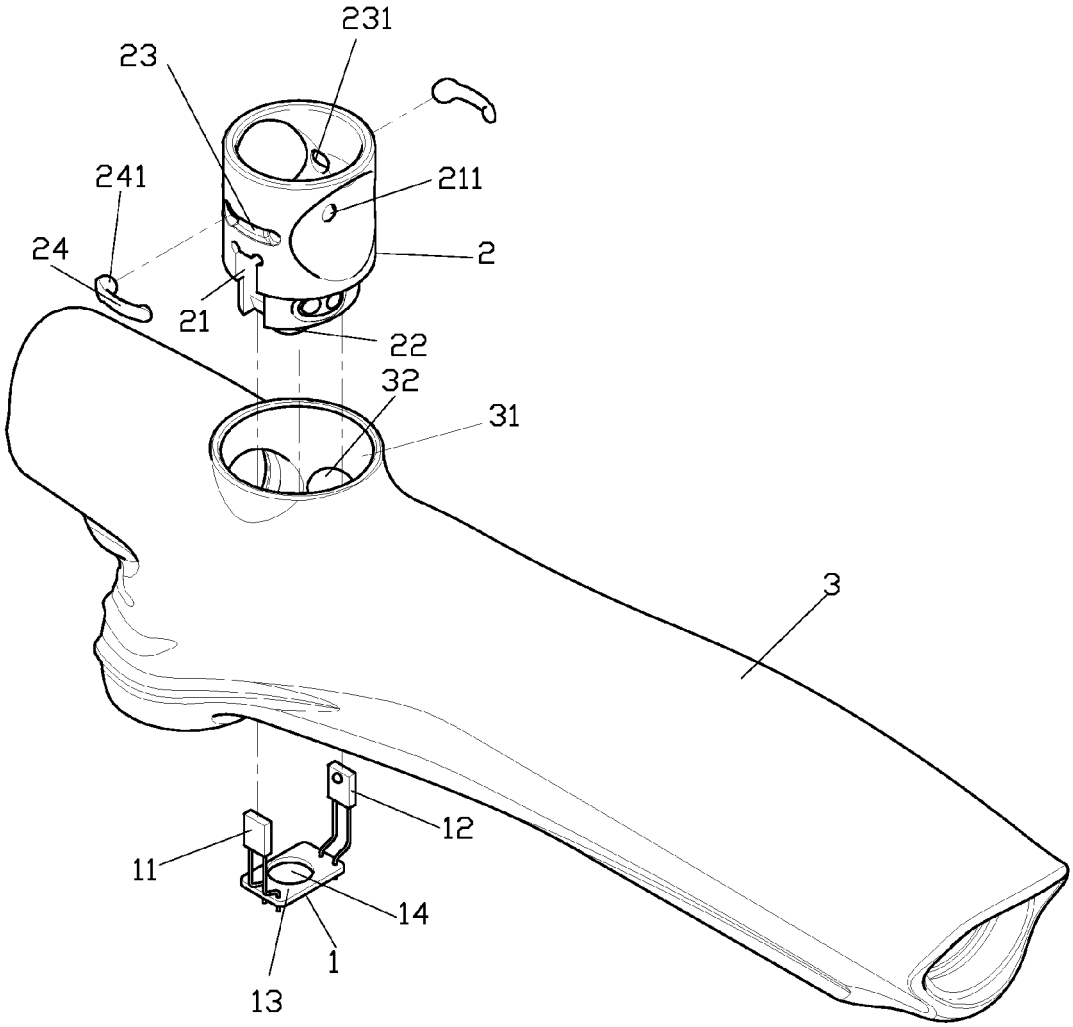
FIG. 1 is an exploded view of the present invention.
Figure 2:
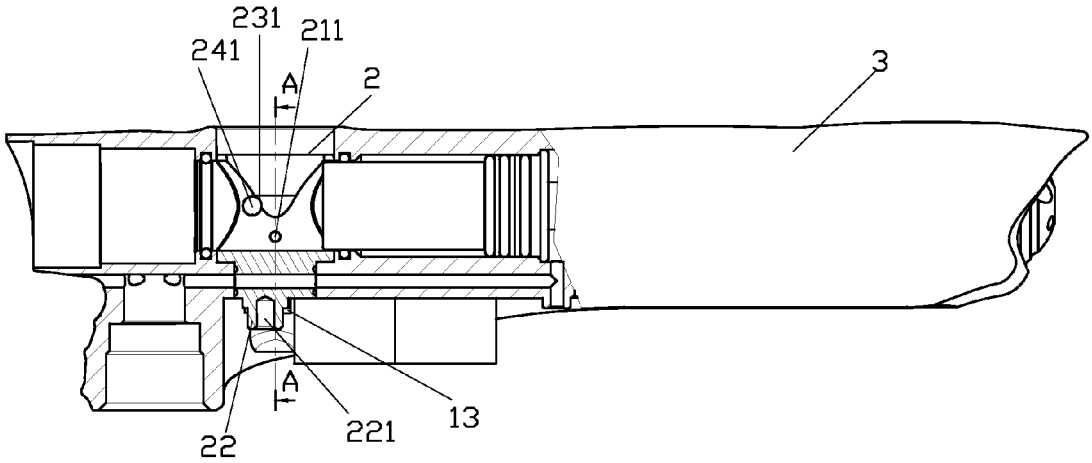
FIG. 2 is a side cross-sectional view of the present invention.
Figure 5:
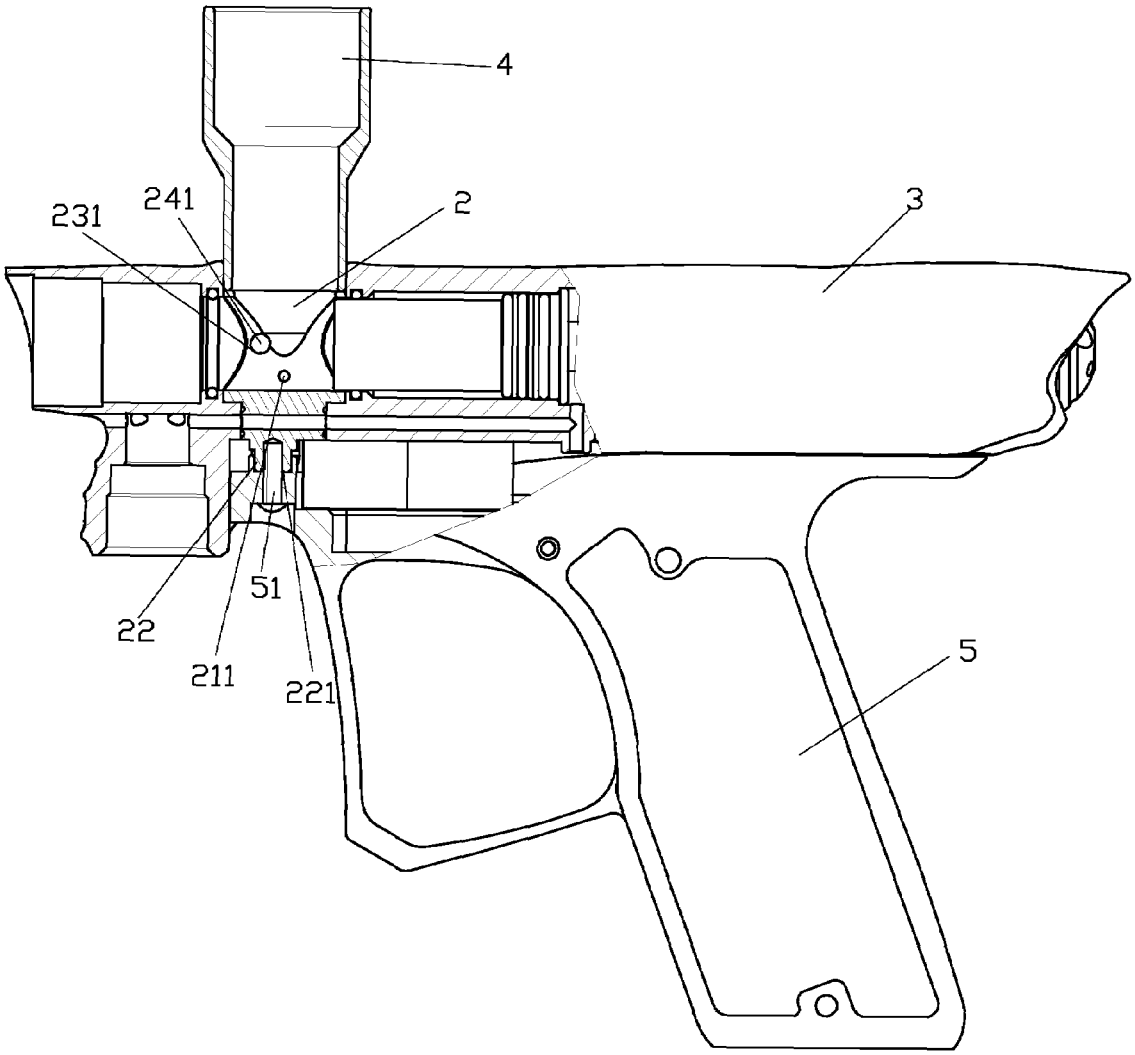
FIG. 5 is a cross-sectional view of the present invention in conjunction with a loader and a gun handle.
Figure 6:
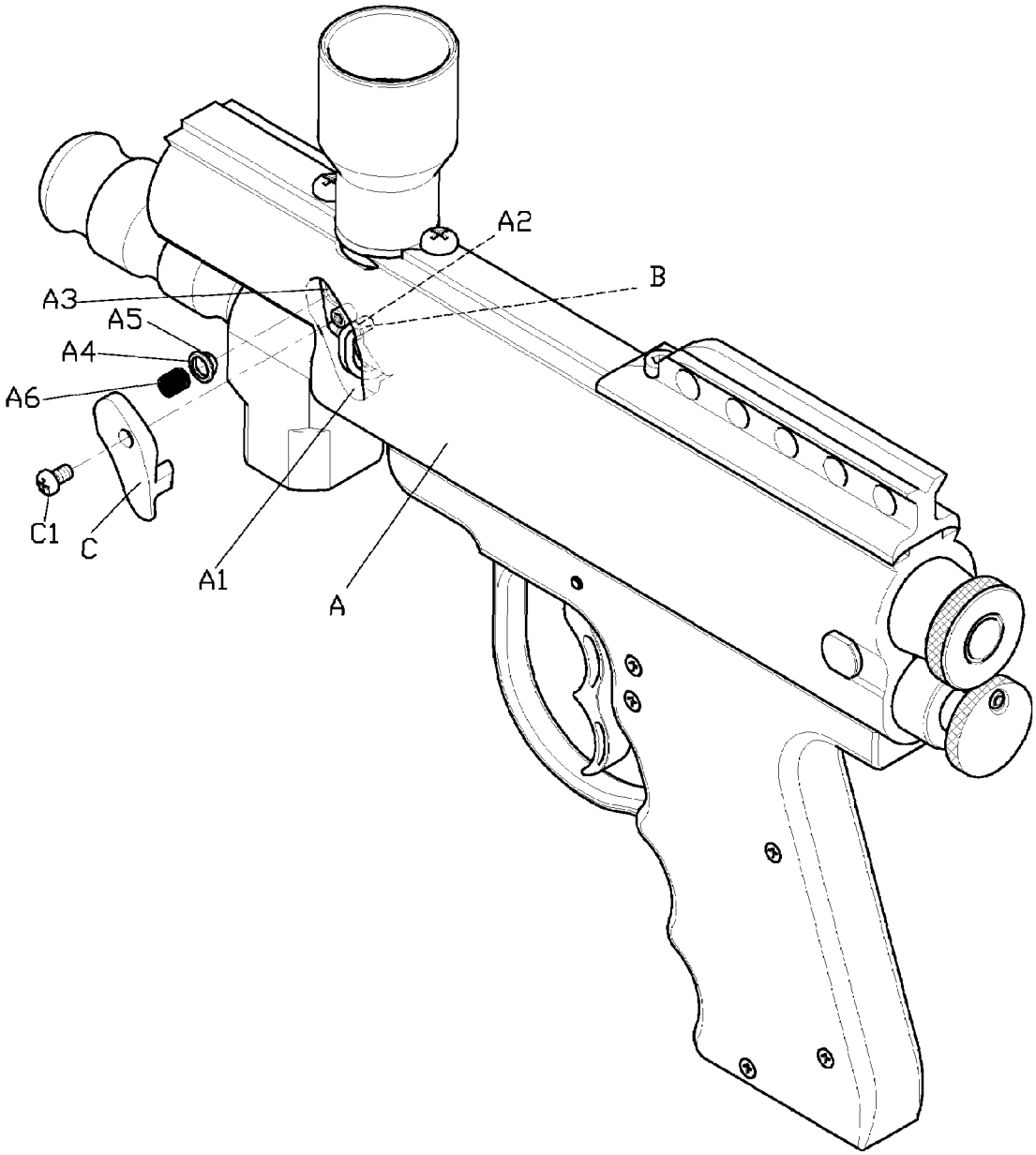
F I G . 6 (PRIOR ART)
FIG. 6 is an exploded view of the prior art.

As shown in FIGS. 1 and 2, a hidden sensor structure for a paintball gun of the present invention comprises a sensor 1, a loader unit 2, and a barrel 3. The barrel 3 has a hopper 31 for the loader unit 2 along with a loader 4 to seat thereon. The loader 4 engages with the loader unit 2, as shown in FIG. 5.

The sensor 1 comprises an emission end 11, a receiving end 12 corresponding to the emission end 11, and a socket 13. The socket 13 has an insertion hole 14 at a central portion thereof.

The loader unit 2 is a hollow cylinder corresponding to the hopper 31 of the barrel 3. The loader unit 2 has a pair of troughs 21 formed on two sides thereof to receive the emission end 11 and the receiving end 12 therein, a first through hole 211 for the emission end 11 and the receiving end 12 to communicate with each other, and a fixture 22 protruding from the bottom of the loader unit 2 for the socket 13 to seat and secure thereat. The fixture 22 has a threaded hole 221 at a central portion for locking. The loader unit 2 further has a pair of arcuate slots 23 above the pair of troughs 21 to receive a pair of resilient stoppers 24 therein. One end of the arcuate slot 23 is formed with a second through hole 231 for a stud 241 protruding from an inner side of the resilient stopper 24 to extend therethrough into the hopper 31 of the barrel 3.

The hopper 31 is formed at the top of the barrel 3 for the loader unit 2 and the loader 4 to seat and secure thereat. A pair of recesses 32 are formed on an inner wall of the hoper 31, corresponding in position to the studs 241 of the resilient stoppers 24.

Figure 3:
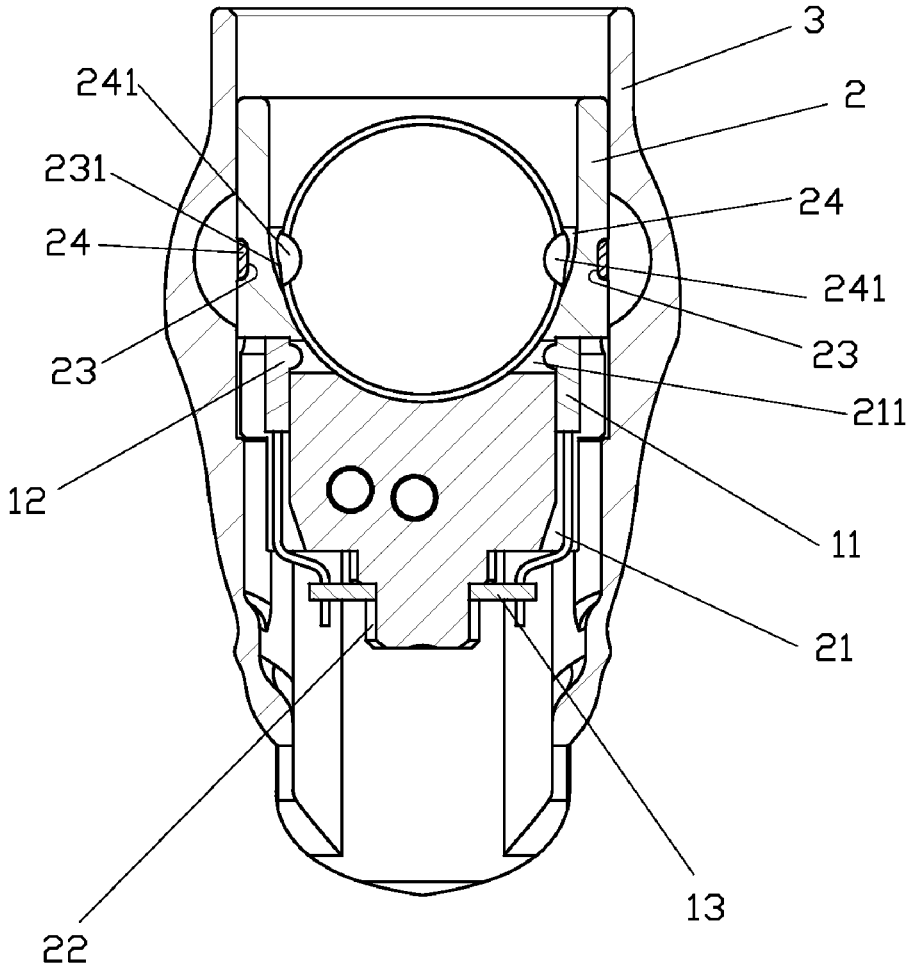
FIG. 3 is a sectional view taken along line A-A of FIG. 2.
Figure 4:
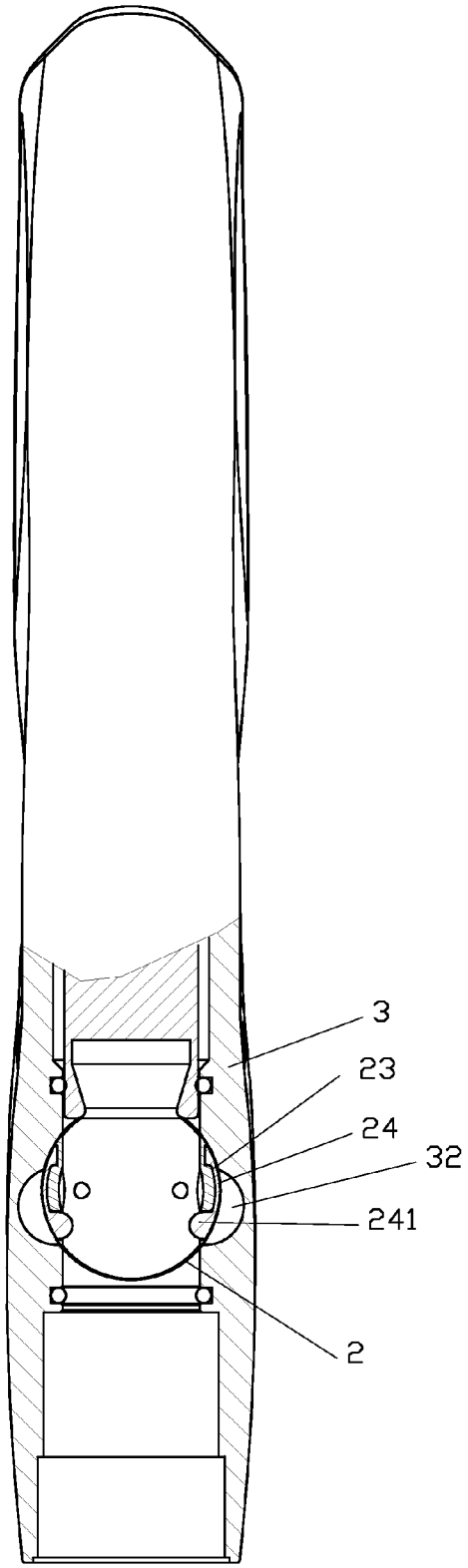
FIG. 4 is a top cross-sectional view showing a loader unit of the present invention.

To assemble the present invention, as shown in FIGS. 1, 3, and 4, the resilient stoppers 24 are inserted into the arcuate slots 23 of the loader unit 2 with the studs 241 extending into the second through holes 231. The loader unit 2 is placed in the hopper 31 of the barrel 3. The resilient stoppers 24 are confined to the inner wall of the barrel 3. The loader 4 is placed on top of the loader unit 2 for providing a pressure against the loader unit 2 to prevent the loader unit 2 from disengagement, as shown in FIG. 5. The studs 241 are extended into the hollow cylinder of the loader unit 2, as shown in FIG. 4, for stopping paintballs. The sensor 1 is coupled to the loader unit 2 from the bottom of the barrel 3, with the emission end 11 and the receiving end 12 inserting into the troughs 21 and the socket 13 engaging with the fixture 22. Thus the sensor 1 is hidden in the barrel 3 securely without a fastener.

As shown in FIG. 5, the present invention is in conjunction with the loader 4 and a gun handle 5. The loader 4 is disposed on top of the loader unit 2. A fastener 51 is inserted into the threaded hole 221 of the fixture 22 such that the loader unit 2 is secured to the handle 5 and the handle 5 is located immediately underneath the barrel 3.

What is claimed is:

1. A hidden sensor structure for a paintball gun, comprising a sensor, a loader unit, and a barrel, said barrel being adapted for said loader unit and a loader to seat therein;

said sensor comprising an emission end, a corresponding receiving end, and a socket, said socket having an insertion hole at a central portion thereof;

said loader unit comprising a pair of troughs at two sides thereof for receiving said emission end and said receiving end therein, a first through hole for said emission end and said receiving end to communicate with each other, and a fixture protruding from a lower end thereof for said socket of said sensor to seat thereon, said fixture having a threaded hole at a central portion thereof;

said barrel having a hopper at an upper end thereof for said loader unit to seat thereon and recesses formed on an inner wall thereof.

2. The hidden sensor structure for a paintball gun, as claimed in claim 1, wherein said loader unit is a hollow cylinder corresponding to said hopper of said barrel.

3. The hidden sensor structure for a paintball gun, as claimed in claim 1, wherein said loader unit further has a pair of arcuate slots above said troughs.

4. The hidden sensor structure for a paintball gun, as claimed in claim 3, wherein one end of each said arcuate slot is formed with a second through hole.

5. The hidden sensor structure for a paintball gun, as claimed in claim 3, wherein said loader unit further comprises a pair of resilient stoppers to be inserted into said arcuate slots.

6. The hidden sensor structure for a paintball gun, as claimed in claim 5, wherein each said resilient stopper has a stud protruding from an inner side thereof, said stud extending through said second through hole into said hopper of said barrel.

* * * * *